US005519956A

United States Patent [19]

Howell

[11] Patent Number: 5,519,956

[45] Date of Patent: May 28, 1996

[54] INTERNAL FIRING MECHANISM LOCK

[76] Inventor: Jesse R. Howell, 238 Kinkle Ave., Mansfield, Ohio 44907

[21] Appl. No.: 138,977

[22] Filed: Oct. 21, 1993

Related U.S. Application Data

[63] Continuation-in-part of Ser. No. 972,934, Nov. 6, 1992, abandoned.

[51] Int. Cl.[6] ..... F41A 17/02

[52] U.S. Cl. ..... 42/70.08; 42/70.11

[58] Field of Search ..... 42/66, 70.01, 70.08, 42/70.11

[56] References Cited

U.S. PATENT DOCUMENTS

| | | | |
|---|---|---|---|
| 273,288 | 3/1883 | Kacer et al. | 42/42.03 |
| 792,382 | 6/1905 | Allen | 42/66 |
| 2,259,397 | 10/1941 | Smith | 42/42.03 |
| 2,994,981 | 8/1961 | Carrigan | 42/70.08 |
| 4,615,133 | 10/1986 | Center | 42/69.01 |
| 5,020,259 | 6/1991 | Mossberg | 42/70.11 |

FOREIGN PATENT DOCUMENTS

| | | | |
|---|---|---|---|
| 232852 | 9/1909 | Germany | 42/42.03 |
| 2355 | of 1875 | United Kingdom | 42/70.08 |

*Primary Examiner*—Stephen C. Bentley

[57] ABSTRACT

A firearm which alloys center fire cartridges, rim fire cartridges of different sizes and types, as well as, black powder loads of different sizes to be fired from the same firearm. The aforestated is accomplished by the present invention entailing three firing pins which are selectively controlled by setting the triple mode selector located on the hammer to the desired setting. The aforementioned firearm has an internal firing mechanism lock which locks the internal firing mechanism and renders the firing mechanism inoperative. The internal firing mechanism lock is actuated by a key which can easily be carried on one's person.

10 Claims, 11 Drawing Sheets

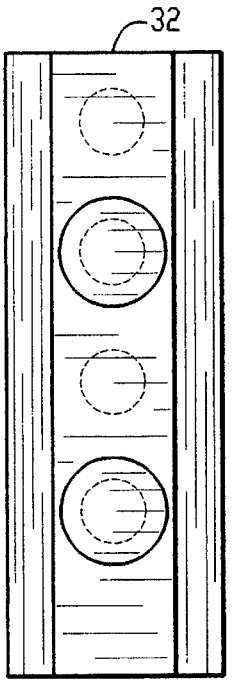
FIG. 5A
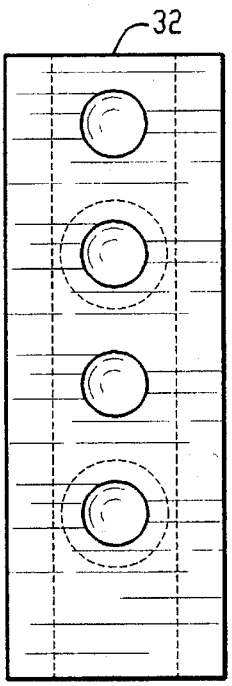
FIG. 5B
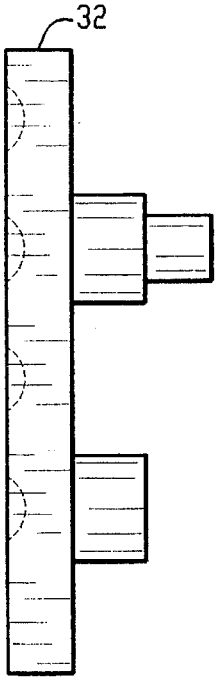
FIG. 5C
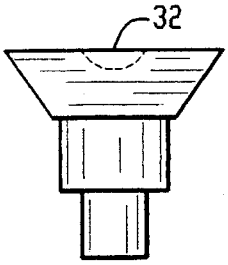
FIG. 5D
FIG. 6A
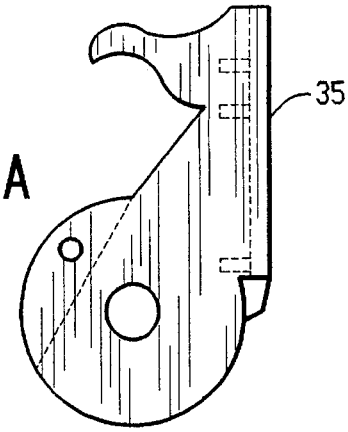
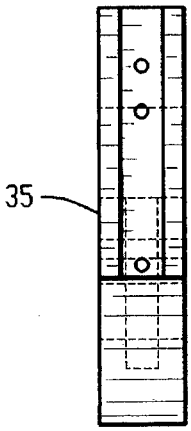
FIG. 6B
FIG. 7A
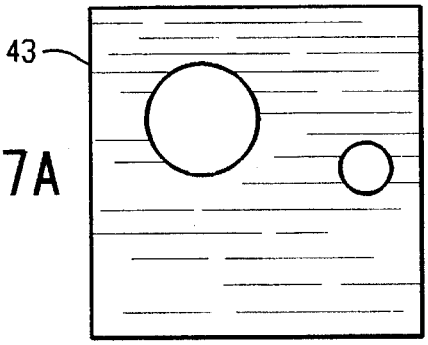
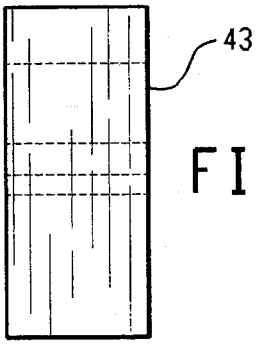
FIG. 7B

INTERNAL FIRING MECHANISM LOCK

CROSS REFERENCE TO RELATED APPLICATION

This is a continuation in part of application Ser. No. 07/972,934 filed Nov. 6, 1992, with drawings, now abandoned.

BACKGROUND OF THE INVENTION (a) Field of the Invention

The present invention relates to fire arms and in particular, the present invention relates go firearms capable of firing cartridges of different sizes from the same firearm. The present invention has an internal firing mechanism lock.

(b) Description of the Prior Art

The fire arms industry has long accepted, as a state of the art, the changing of barrels, to fire different size cartridges or loads. No attempt to alter that basic principle is involved with the present invention. There is not now, nor ever has been, a fire arm that can fire either, rim fire, center fire, or black powder loads, in a choice of cartridges or load sizes from the same fire arm without major adaptation. However, several attempts have been make to accomplish a combination of cartridge and black powder firing guns and fire arms. Such as: (a) U.S. Pat. No. 173,476 Ladd 1876, with this invention one is limited to the caliber of the fire arm and no other, the plug is also costly to manufacture; (b) U.S. Pat. No. 4,437,249 Brown and Sirous March 1984 again this limits one to one caliber, that of the gun, this plug is also costly to manufacture. (c) U.S. Pat. No. 4,644,930 Mainhardt this invention, will allow a couple of different calibers including center fire and rim fire, as well an insert for firing rockets; (d) U.S. Pat. No. 4,232,468 Chapin November 1980 this invention incorporates the costly plus and again limits one to one caliber, that of the firearm itself; (e) U.S. Pat. No. 4,912,868 Thompson April 1990, this invention requires the most mechining, and requires the making of new parts to accept the black powder parts. Again one is limited to one caliber and that is that of the firearm.

OBJECTS AND ADVANTAGES

Accordingly, besides the objects and advantages of previous fire arms my invention's objects and advantages are:

A. To provide a very versitile weapon for any occasion.

B. To provide a weapon for home defense.

C. To provide a weapon for use on the target range.

D. To provide a weapon that can be used in any type of hunting in the world.

E. To provide a weapon that fires rim fire cartridges.

F. To provide a weapon also that will fire center fire cartridges.

G. To provide a weapon that will fire black powder loads as well.

H. To provide a weapon that has an internal firing mechanism that can be locked in and of itself without the aid of an external apparatus, thus rendering the weapon harmless unless the internal firing mechanism is unlocked.

I. To provide a weapon with an easy handling: in the home, on the range, and in the hunting field.

J. To provide a weapon while hunting in the field of one's choice, if instructions are followed, can be silently cocked without disturbing the game one is hunting.

SUMMARY OF THE INVENTION

One of the principal objects of the present invention is to provide a fire arm capable of firing rimfire, and center fire as well as black powder loads all from the same fire arm without no adaptation. Previous inventors have tried to accomplish this, which requires substantial amounts of revisions, alterations, adaptation and effort which requires a shop atmosphere to accomplish the same. In certain instances different stocks and frame works was required for mounting and firing cartridges or black powder loads. It is also an object of the present invention to provide a fire arm which can be changes in the field from rim fire caliber of .22, to center fire caliber of .50, to black powder of .22 to .50 calibers.

Second principal object of the present invention is an internal firing mechanism lock, which renders the fire arm totally inoperative, and incapable of firing in and of itself.

(1) Triple mode firing selector, FIG. 6 A hammer made as a allow ease of movement to the triple mode firing selector to rim fire, center fire or black powder loads to be fired, FIG. 6 will be installed into FIG.5.

(2) Special firing pins, FIG. 2 thru FIG. 4. Note: That FIG. 4 will be assembled inside of FIG. 3. FIG. 4 is that of the center fire firing pin. FIG. 3 is that of the black powder firing pin, and FIG. 2 is that of the rim fire firing pin all of which will be placed into the receiver frame for proper operation.

(3) An all new internal firing mechanism lock FIG. 8. FIG. 7 is the internal firing mechanism lock cover, and FIG. 9 is the key which locks and unlocks the internal firing mechanism lock that is located within the receiver frame.

(4) Further claim that this gun can handle rim fire, center fire, and black powder loads off of the same receiver frame by the changing of barrels, and the changing of the triple mode firing selector.

BRIEF DESCRIPTION OF THE DRAWINGS

In the annexed drawings:

FIGS. 5A–5D are front, back, side and top views of a triple mode selector.

FIGS. 6A–6B are side and front views of the triple mode selector hammer.

FIGS. 7A–7B are front and side views of a firing mechanism lock cover.

DESCRIPTION OF PREFERRED EMBODIMENT

Triple Mode Selector Means 32, Triple mode selector, drawing (FIG. 5), is housed in means 35, drawing (FIG. 6).

Figure 13:
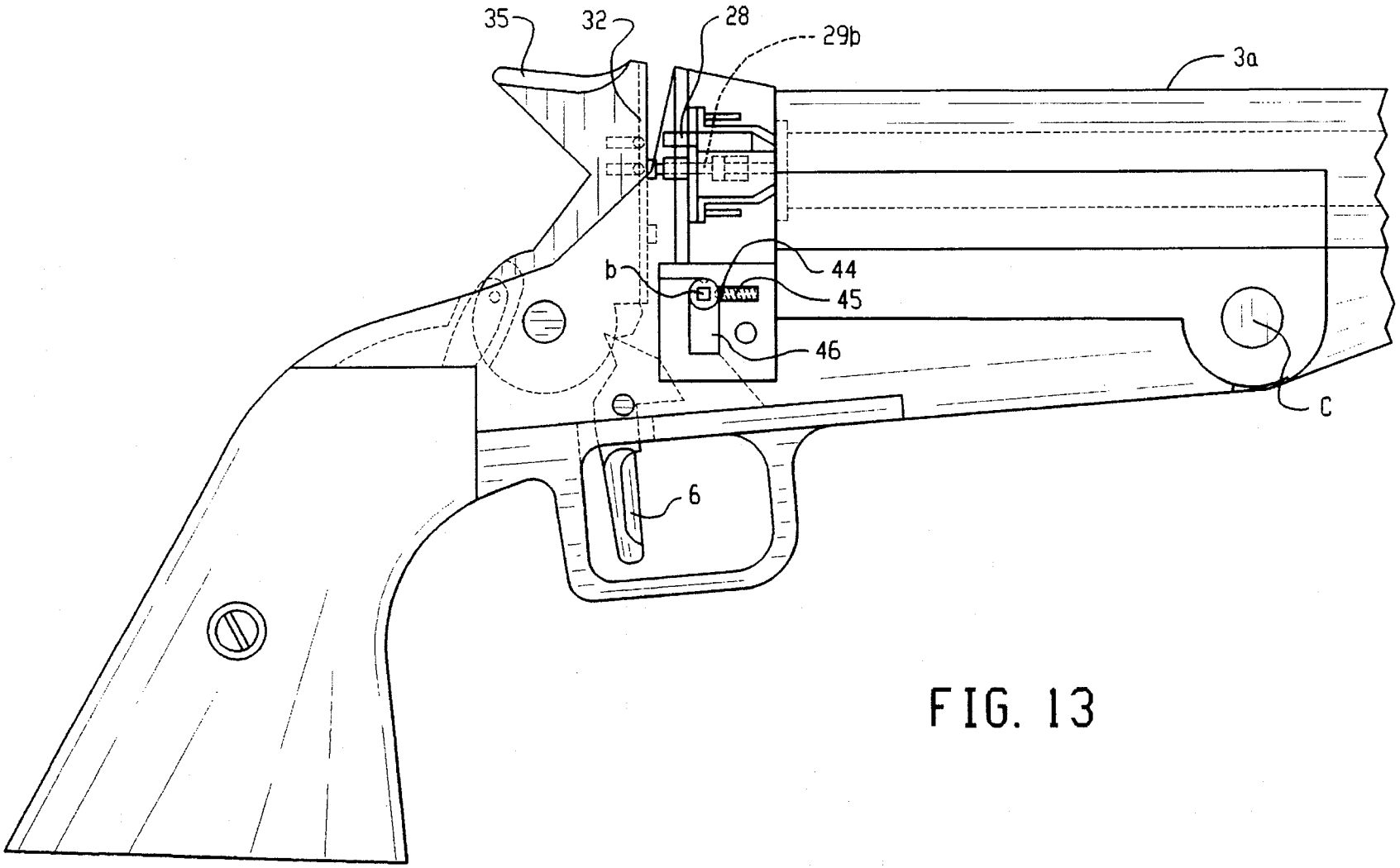
FIG. 13 is a side view of a gun showing the triple mode selector in the center fire position and the internal firing mechanism in the open or unlocked position.
Figure 14:
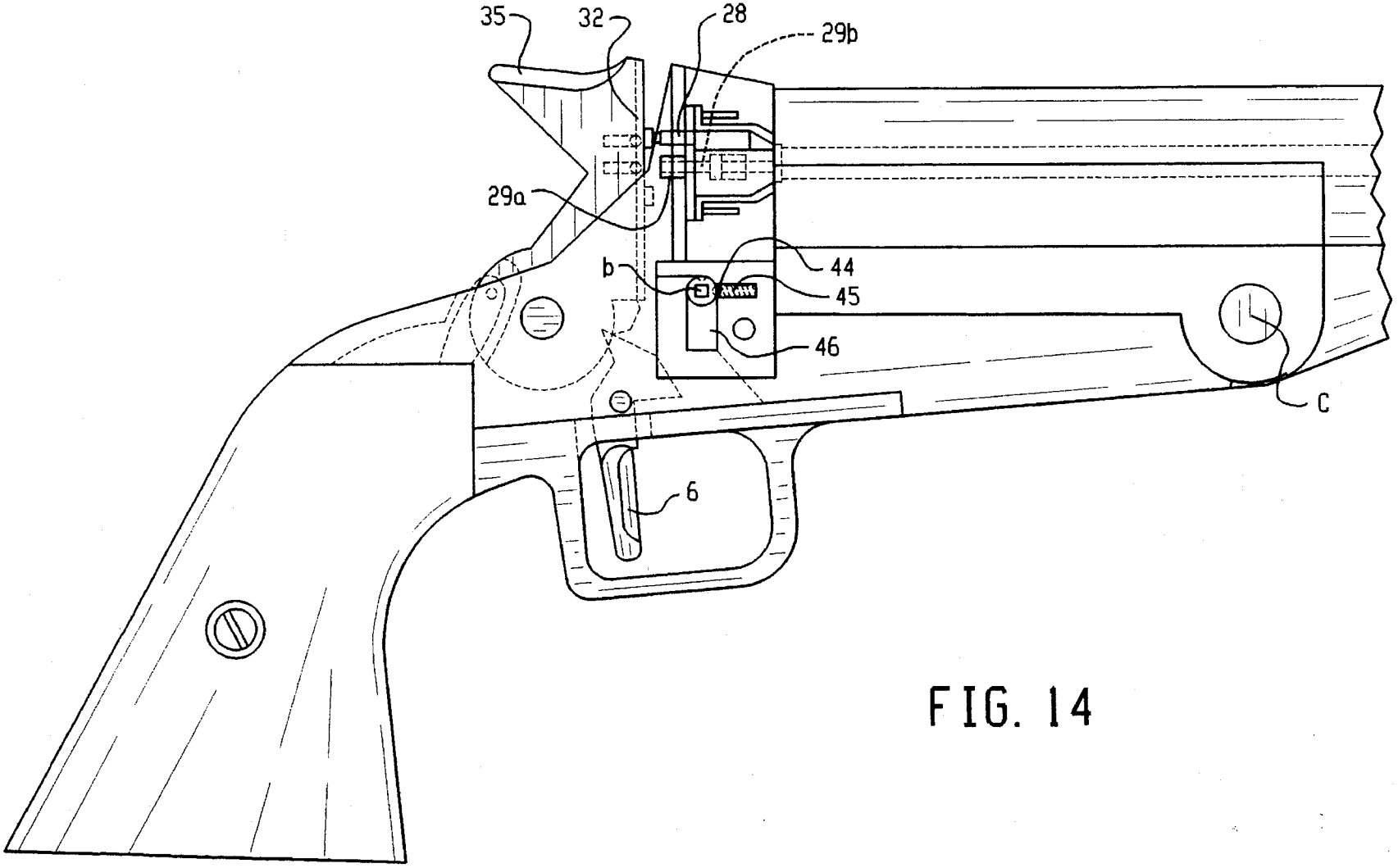
FIG. 14 is a side view of a gun showing the triple mode selector in the rim fire position and the internal firing mechanism in the open or unlocked position.
Figure 15:
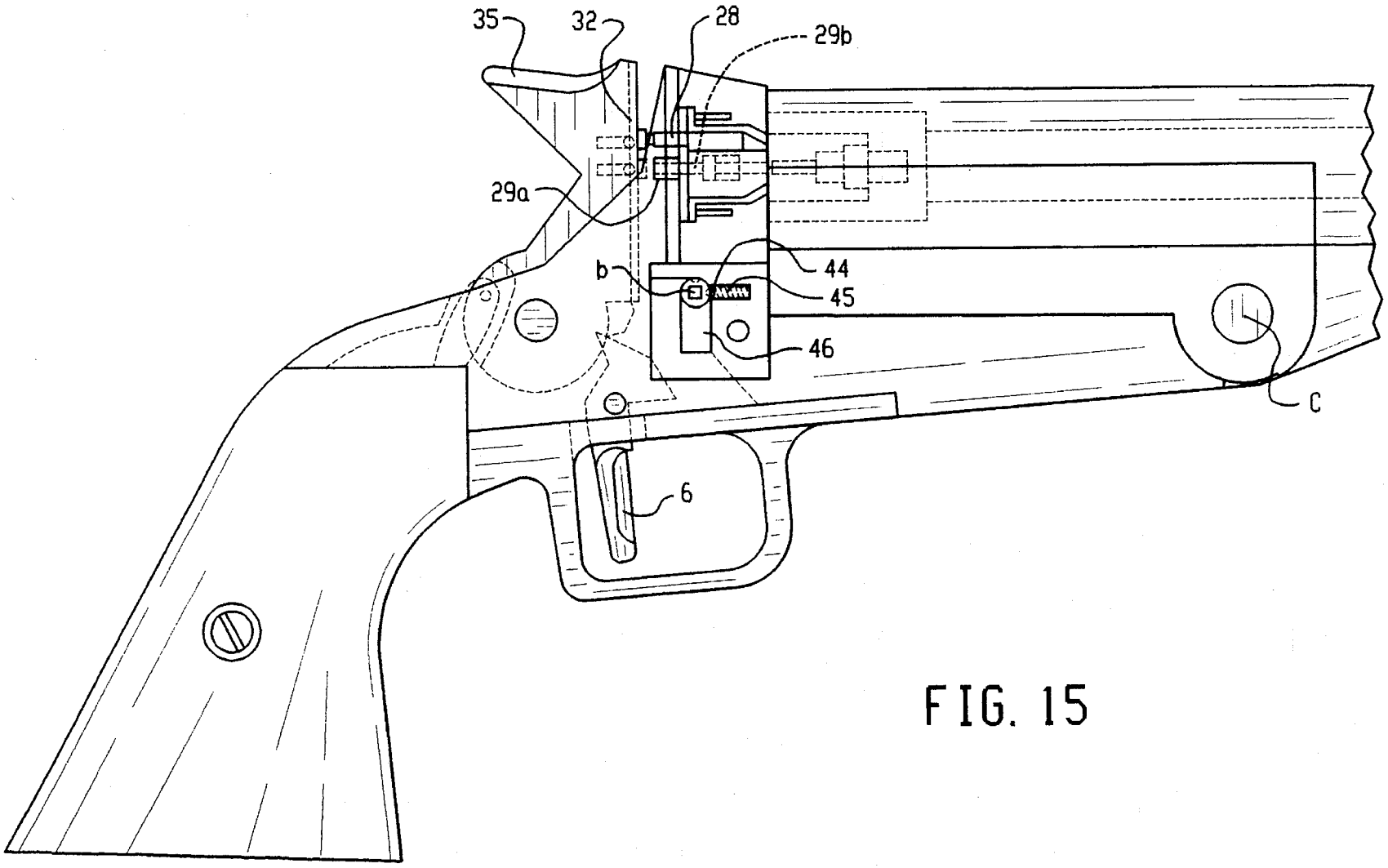
FIG. 15 is a side view of a gun showing the triple mode selector in the black powder firing position and the internal firing mechanism in the open or unlocked position.

Mean 32, triple mode selector, has a triple (three) function mode. In mode 1 means 32 is set in rimfire firing mode, drawing (FIG. 14), and strikes means 28, drawing (FIG. 2), when means 35, drawing (FIG. 6), is activated from a fully cocked position when trigger means 6, drawing (FIG. 13, 14, 15), is depressed. In mode 2 means 32 is set for centerfire firing mode, drawing (FIG. 13,) and will strike means **29*b*, drawing (FIG. 4), when means 35, drawing (FIG. 6) is in a fully cocked position when trigger means 6, drawing (FIGS. 13, 14, 15) is depressed. In mode 3 means 32 is set for black-powder firing mode, drawing (FIG. 15), and will strike means 29*a*, drawing (FIG. 3) when means 35, drawing (FIG. 6), is activated from a fully cocked position when means 6, drawing (FIGS. 13, 14, 15), is depressed. Means 35, drawing (FIG. 6), is activated by a spring means 38, drawing (FIG. 1), and a rod means 37, drawing (FIG. 1), and released into motion when means 6 drawing (FIGS. 13, 14, 15**) is depressed, thus firing the weapon.

Triple Mode firing pins. Means 1, receiver frame, drawing (FIG. 1), houses means 28, **29*a*, and 29*b*, in a position as to allow means 32, triple mode firing pin drawing (FIG. 5), to strike means 28, 29*a*, and 29*b* when means 35 (drawing FIG. 6), is activated and means 32** is positioned in the desired mode.

Figure 3A:
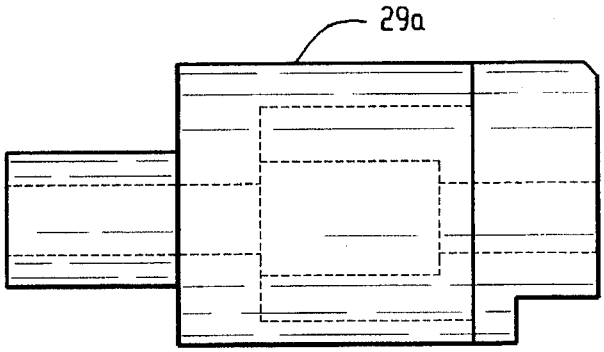
FIGS. 3A–3B are side and front views of the black powder firing pin.
Figure 3B:
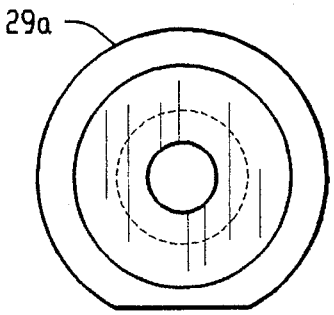
Figure 4A:
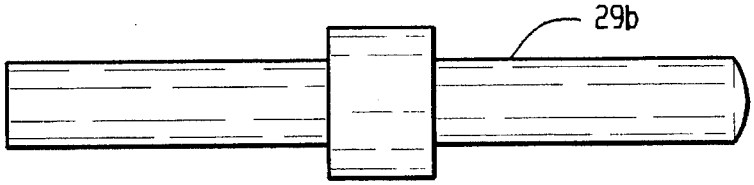
FIGS. 4A–4B are side and front views of a center firing pin.
Figure 4B:
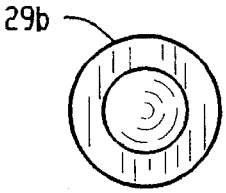

A. Means 28 rimfire firing pin, drawing (FIG. 2), will operate independently of means **29*a*, drawing (FIG. 3), and means 29*b* drawing (FIG. 4**).

Figure 2A:
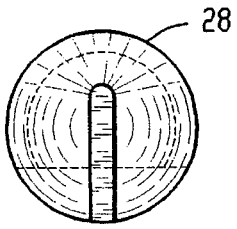
FIGS. 2A–2C are front, side and top views of the rim firing pin.
Figure 2B:
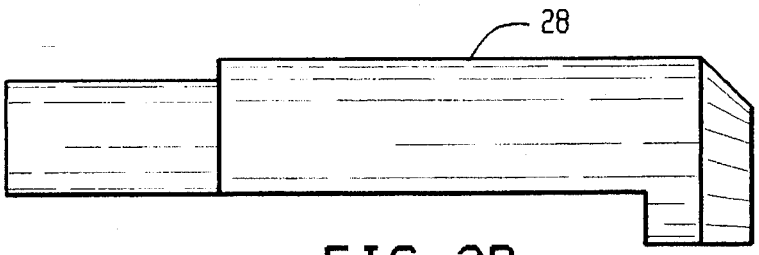
Figure 2C:
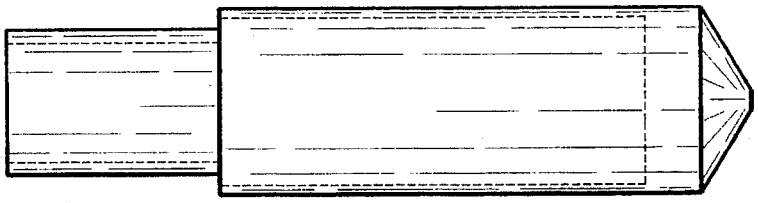

B. Means **29*b*, drawing (FIG. 4), the center firefiring pin will operate independently if means 28, drawing (FIG. 2), and means 29*a*, drawing (FIG. 3), when struck by means 32, drawing (FIG. 5), as means 35, is activated C. Means 29*a*, drawing (FIG. 3), the black powder firing pin houses within itself means 28, drawing (FIG. 2). Both means 28 and means 29*a* operate together when struck by means 32, drawing (FIG. 5**).

D. When means 32 is positioned in black powder firing mode on means 35, drawing (FIG. 6), and means 35 is activated by pulling on means 6 trigger, drawing (FIG. 1), which starts the forward pushing of means 38, hammer push spring, drawing (FIG. 1), guided by means 37, hammer activating rod, drawing (FIG. 1), which pushes means 35, drawing (FIGS. 1, and 6), in a forward motion until means 32 drawing (FIGS. 1 and 5) strikes the pin in which mode means 32 is set to strike. All of the above takes place after the means 35, the hammer, is pulled back to fully cocked position and means 6, trigger is pulled to start the activating swing of means 35.

Firing Mechanism Lock

Figure 8A:
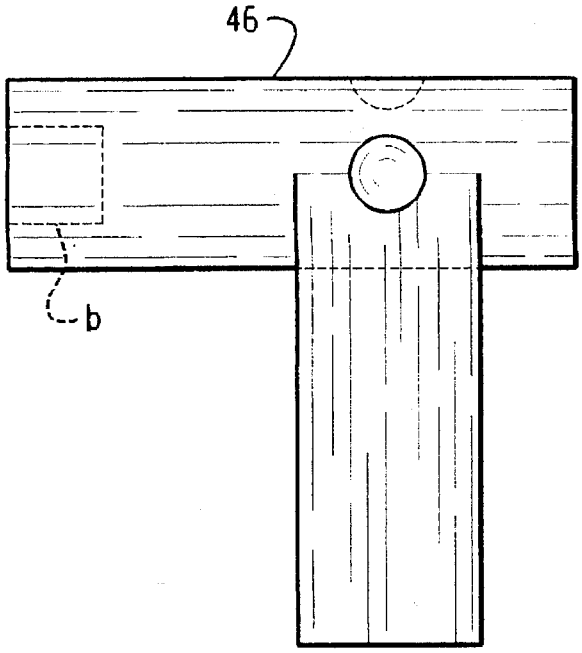
FIGS. 8A–8B are side and end views of the firing mechanism lock.
Figure 8B:
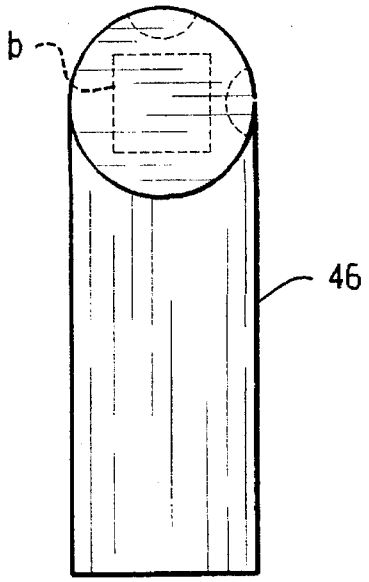
Figure 9A:
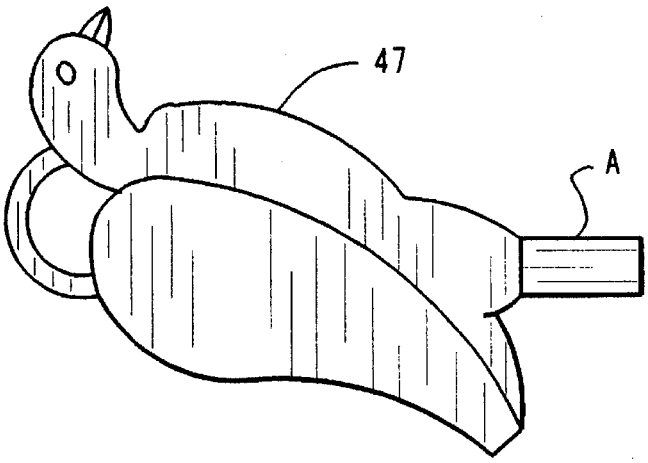
FIGS. 9A–9B are side and bottom views of a firing mechanism lock key.
Figure 9B:
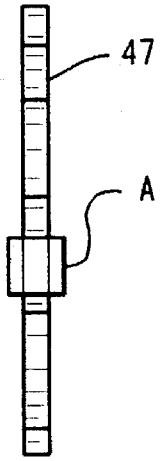
Figure 16:
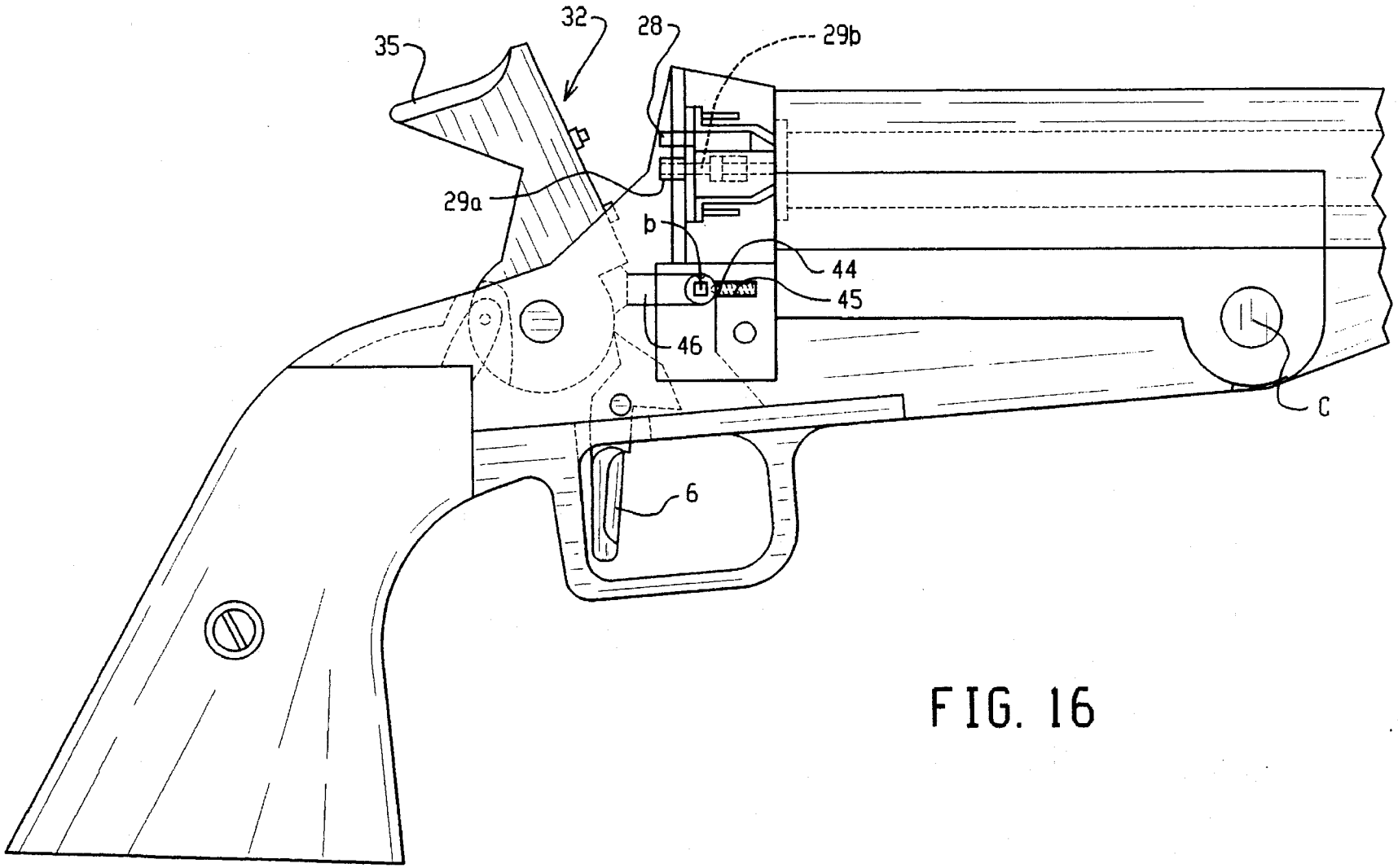
FIG. 16 is a side view of a gun showing the internal firing mechanism lock in the closed or locked position.

Tab A on means 47, drawing (FIG. 9), firing mechanism lock key is to be inserted into recess b on means 46, firing mechanism lock, drawing (FIG. 8), as shown on drawings (FIGS. 13, 14, 15) in which the means 46 firing mechanism lock is shown in unlocked position and turned or rotated clockwise until means 46, firing mechanism lock, stops rotating. Means 46, firing mechanism lock, stops the activating swing of means 35, drawing (FIG. 6) as shown on drawing (FIG. 16) and will not allow means 35 hammer, drawing (FIG. 6), to strike means 28, **29*a*, or 29*b*, means 28, rimfire firing pin, means 29*a* black powder firing pin, means 29*b* center fire firing pin as shown on drawings 2, 3, and 4**. Thus locking the firing mechanism which in turn stops the weapon from being fired.

Capability of firing, rimfire, center fire, and black powder barrels from the same receiver frame.

Figure 1:
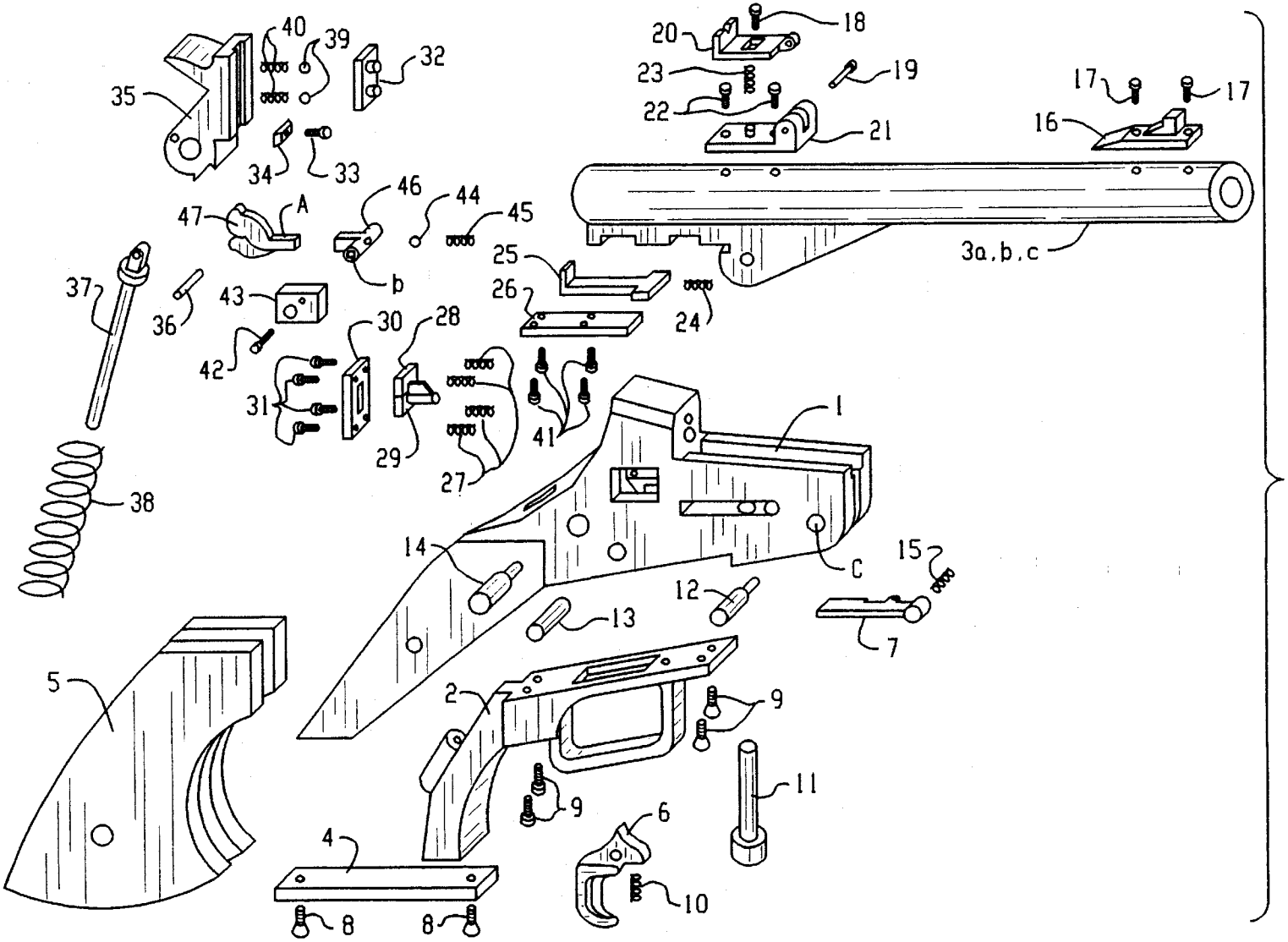
FIG. 1 is an exploded isometric view of the preferred embodiment showing all components.
Figure 10B:
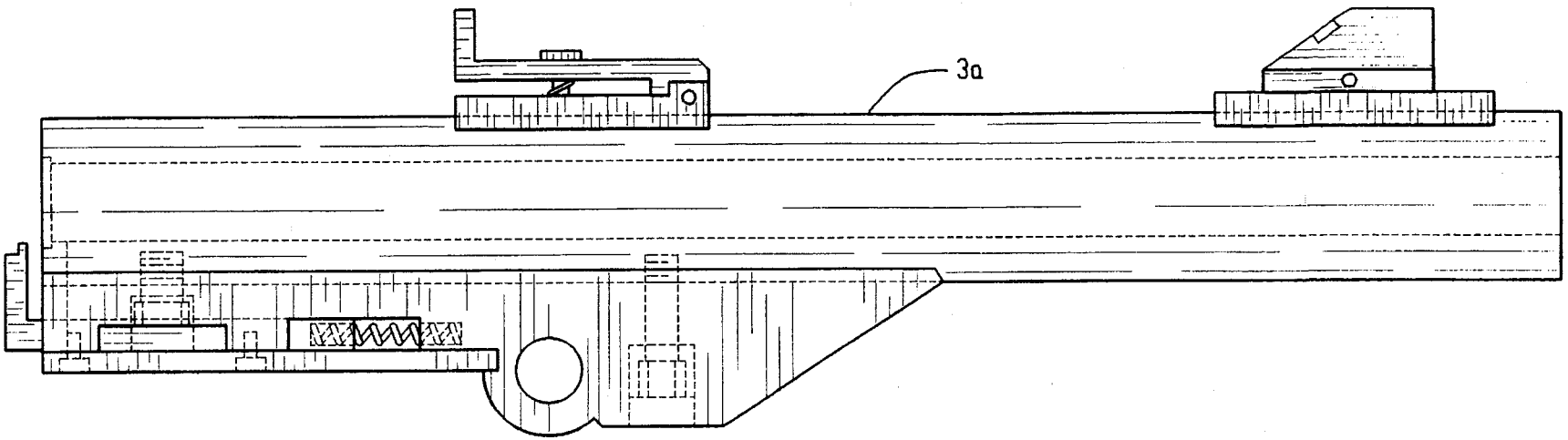
FIGS. 10A–10B are back and side views of the center fire barrel.
Figure 10A:
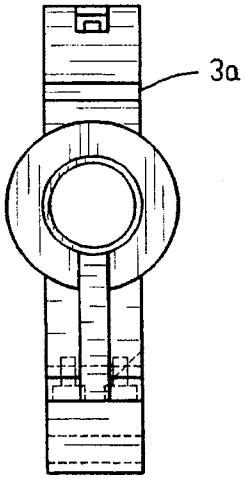
Figure 11B:
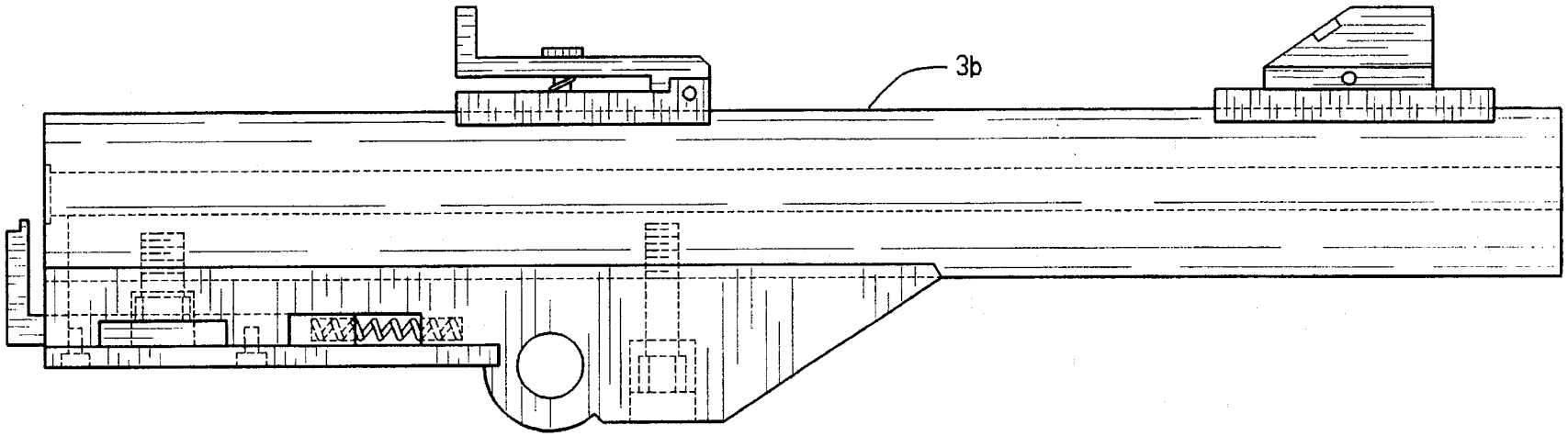
FIGS. 11A–11B are back and side views of the rim fire barrel.
Figure 11A:
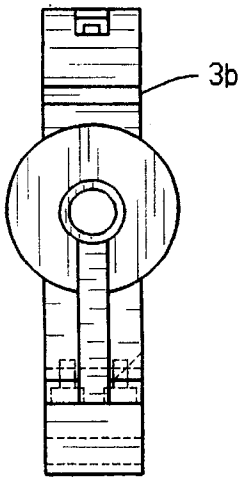
Figure 12B:
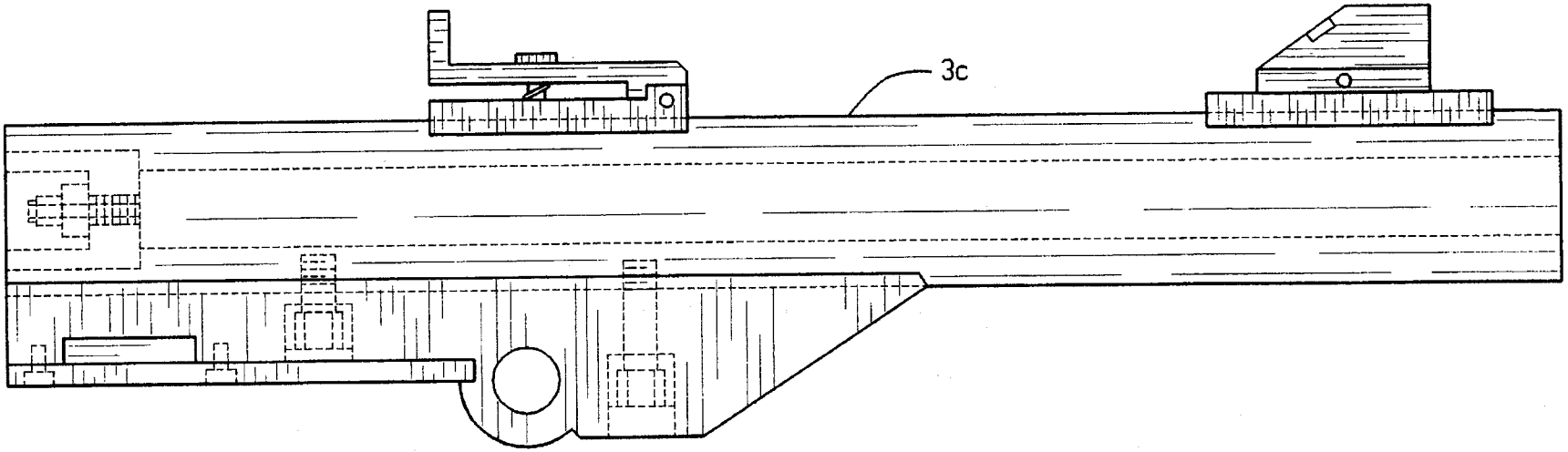
FIGS. 12A–12B are back and side views of a black powder barrel.
Figure 12A:
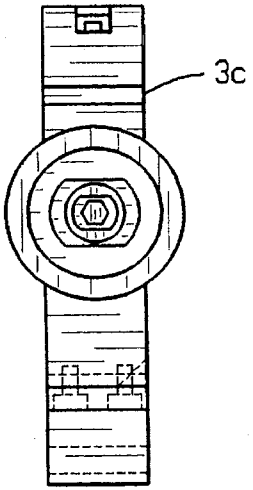

Means 1, receiver frame, drawing (FIG. 1), is capable of firing means **3*a*, drawing (FIG. 10), centerfire barrel means 3*b*, drawing (FIG. 11), rimfire barrel, and means 3*c*, drawing (FIG. 12), black powder barrel from the same receiver frame, drawing (FIG. 1**).

Means **3*a*, drawing (FIG. 10), is a center fire barrel for center fire calibers. Means 3*b*, drawing (FIG.11), is a rimfire barrel for rimfire calibers. Means 3*c*, drawing (FIG. 12), is a black powder barrel for black powder calibers. As stated above in this application, the changing of barrels has long since been established, and it is not an attempt of this application to attempt to show the changing of barrels. It is, however, as is disclosed herein an object of this patent application to present an invention capable of firing several types and styles of ammunition from the same receiver frame, namely, rim fire calibers, center fire calibers, and black powder calibers. This is achieved by removing means 12, drawing (FIG. 1), barrel pivot pin from receiver frame at point C then removing the existing barrel from the receiver frame and replacing the removed barrel with the barrel of choice into the receiver frame and reinserting means 12 into means 1** at point C Therefore, it is possible for this invention to fire center fire calibers, rimfire calibers and black powder calibers from the same receiver frame.

A. When means **3*a*, drawing (FIG. 10), center fire barrel is installed into means 1, drawing (FIG. 1), then means 32, drawing (FIG. 5),must must be adjusted for center fire firing mode, drawing (FIG. 13), so that means 32, drawing (FIG. 5), strikes means 29*b*, drawing (FIG. 4), center fire firing pin to fire the gun when means 35, drawing (FIG. 6), is released by the pulling of means 6, drawing (FIG. 1**), the trigger.

B. When means **3*b*, drawing (FIG. 11), rim fire barrel is installed into means 1, drawing (FIG. 1), then means 32, drawing (FIG. 5), must be adjusted to rim fire firing mode, drawing (FIG. 14), so that means 32, drawing (FIG. 5), strikes means 28, drawing (FIG. 2), rim fire firing pin to fire the gun when means 35, drawing (FIG. 6), is released by the pulling of means 6, drawing (FIG. 1**), the trigger.

C. When means **3*c*, drawing (FIG. 12) , black powder barrel is installed into means 1, drawing (FIG. 1), then means 32, drawing (FIG. 5), must be adjusted for black powder firing mode, drawing (FIG. 15) so that means 32, drawing (FIG. 5), will strike means 29*a*, drawing (FIG. 3), black powder firing pin to fire the gun when means 35, drawing (FIG. 6), is released by the pulling of means 6, drawing (FIG. 1**), the trigger.

The following is a list of the various reference numerals and parts designated thereby as illustrated in the drawings hereof:

1. Receiver ffame
2. Trigger guard
3. Barrel a. center fire; b. rimfire; c. black powder
4. Butt plate strap
5. Grips
6. Trigger
7. Barrel catch release
8. Butt plate strap screws
9. Trigger guard screws
10. Trigger return spring
11. Barrel catch release retainer screw
12. Barrel pivot pin
13. Trigger pivot pin
14. Hammer pivot pin
15. Barrel catch release return spring
16. Front sight
17. Front sight screw
18. Rear sight elevation adjusting screw
19. Rear sight windage adjusting screw
20. Moveable section of rear sight
21. Fixed section of rear sight
22. Rear sight mounting screws
23. Rear sight elevation spring
24. Ejector spring
25. Ejector
26. Ejector cover plate
27. Firing pin return spring
28. Rimfire firing pin
29. Black powder and center fire firing pins
30. Firing pins cover plate
31. Firing pins cover plate screws
32. Triple mode firing selector
33. Triple mode firing selector stop
34. Triple mode firing selector stop screw
35. Hammer
36. Hammer actuation pivot pin
37. Hammer actuator
38. Hammer actuating spring
39. Triple mode firing selector retaining balls (steel)
40. Triple mode firing selector retain ball spring
41. Ejector plate cover screws
42. Internal firing mechanism lock cover plate screw
43. Internal firing mechanism lock cover plate
44. Internal firing mechanism lock retaining ball (steel)
45. Internal firing mechanism lock retaining ball spring
46. Internal firing mechanism lock
47. Internal firing mechanism lock actuating key

What is claimed as new is as follows:

1. A firing mechanism lock assembly comprising a round steel ball, a spring, a rotating lever, a cover plate, and an actuating key, said rotating lever including a lock surface for engaging a hammer of a gun firing system to lock the gun by blocking movement of the hammer sufficient to cause firing, said actuating key being cooperative with said rotating lever to rotate said lever to place said surface in confronting engagement with respect to the hammer to effect locking or to a position that does not confront the hammer and does not effect locking, said spring and ball being cooperative to provide a detent function resiliently tending to maintain the rotating lever in such locked position unless rotated by the actuating key to the unlocked position.

2. The assembly of claim 1, said rotating lever including a detent opening therein for receiving a portion of said ball.

3. The assembly of claim 1, said surface of said rotating lever comprising a flat surface.

4. The assembly of claim 1, said rotating lever comprising a generally cylindrical portion about which the rotating lever may rotate.

5. The assembly of claim 4, further comprising a support extending generally perpendicularly to the axis of said cylindrical portion for supporting said lock surface in space relation from said cylindrical surface.

6. The assembly of claim 1, said actuating key comprising a polygonal member and said rotating lever having a corresponding polygonal opening for receiving said polygonal member.

7. The assembly of claim 6, said actuating key including an enlarged area for manually manipulating said polygonal member.

8. The assembly of claim 1, further comprising a support mechanism for supporting a gun hammer and for supporting in relation to said hammer said rotating lever for operation by said actuating key to place said lock surface selectively in locked or unlocked condition in response to actuation by said actuating key.

9. The assembly of claim 8, said support comprising a receiver frame, and further comprising a barrel attached to the receiver frame.

10. The assembly of claim 9, further comprising a trigger coupled with respect to said receiver frame and operable to operate the hammer.

* * * * *